United States Patent [19]

Gerhold

[11] 4,364,356

[45] Dec. 21, 1982

[54] EXHAUST EMISSIONS CONTROL SYSTEM

[75] Inventor: Clarence G. Gerhold, Palatine, Ill.

[73] Assignee: UOP Inc., Des Plains, Ill.

[21] Appl. No.: 436,559

[22] Filed: Jan. 25, 1974

Related U.S. Application Data

[63] Continuation-in-part of Ser. No. 286,650, Sep. 5, 1972, Pat. No. 3,797,301.

[51] Int. Cl.[3] ..... F02P 3/00

[52] U.S. Cl. ..... 123/440; 123/489; 60/276; 60/285

[58] Field of Search ..... 60/274, 276, 285; 123/32 EA, 119 R; 137/93, 487.5; 318/610; 431/76; 235/150.1

[56] References Cited

U.S. PATENT DOCUMENTS

| | | | |
|---|---|---|---|
| 2,389,797 | 11/1945 | MacNeil | 60/276 |
| 3,383,190 | 5/1968 | Weber | 137/93 |
| 3,553,903 | 1/1971 | Christie | 235/150.1 |
| 3,554,212 | 1/1971 | Maroney | 137/93 |
| 3,696,618 | 10/1972 | Boyd | 60/276 |
| 3,759,232 | 9/1973 | Wahl | 60/276 |
| 3,768,259 | 10/1973 | Carnahan | 60/276 |
| 3,782,347 | 1/1974 | Schmidt | 60/276 |
| 3,875,907 | 4/1975 | Wessel | 60/276 |

*Primary Examiner*—Ronald B. Cox

*Attorney, Agent, or Firm*—James R. Hoatson, Jr.; Barry L. Clark; William H. Page, II

[57] ABSTRACT

Exhaust emissions control system provides effective control of hydrocarbons, carbon monoxide, and nitrogen oxides by adjusting the air-fuel ratio of an internal combustion engine having a catalytic converter in its exhaust path in response to the percentage oxygen content of the exhaust gases as measured by a voltage generating oxygen sensor positioned in the exhaust path. The electrical signal produced by the oxygen sensor is compared to a set point signal which corresponds to the desired oxygen content which prevails when the conversion of the exhaust gases is optimized and a correcting step adjustment is made in the air-fuel ratio when there is a difference in the signals. To minimize hunting and still provide a relatively rapid response, the system incorporates a time delay to permit each adjustment made in the air-fuel ratio to be reflected in the output of the exhaust gases before the oxygen content of such exhaust gases is sensed preliminary to make succeeding step adjustments. By providing a time delay equal to the time required for a predetermined number of engine revolutions, the length of the delay can be varied greatly so as to closely approximate the different response times required by the engine system at idle or at high speed.

4 Claims, 1 Drawing Figure

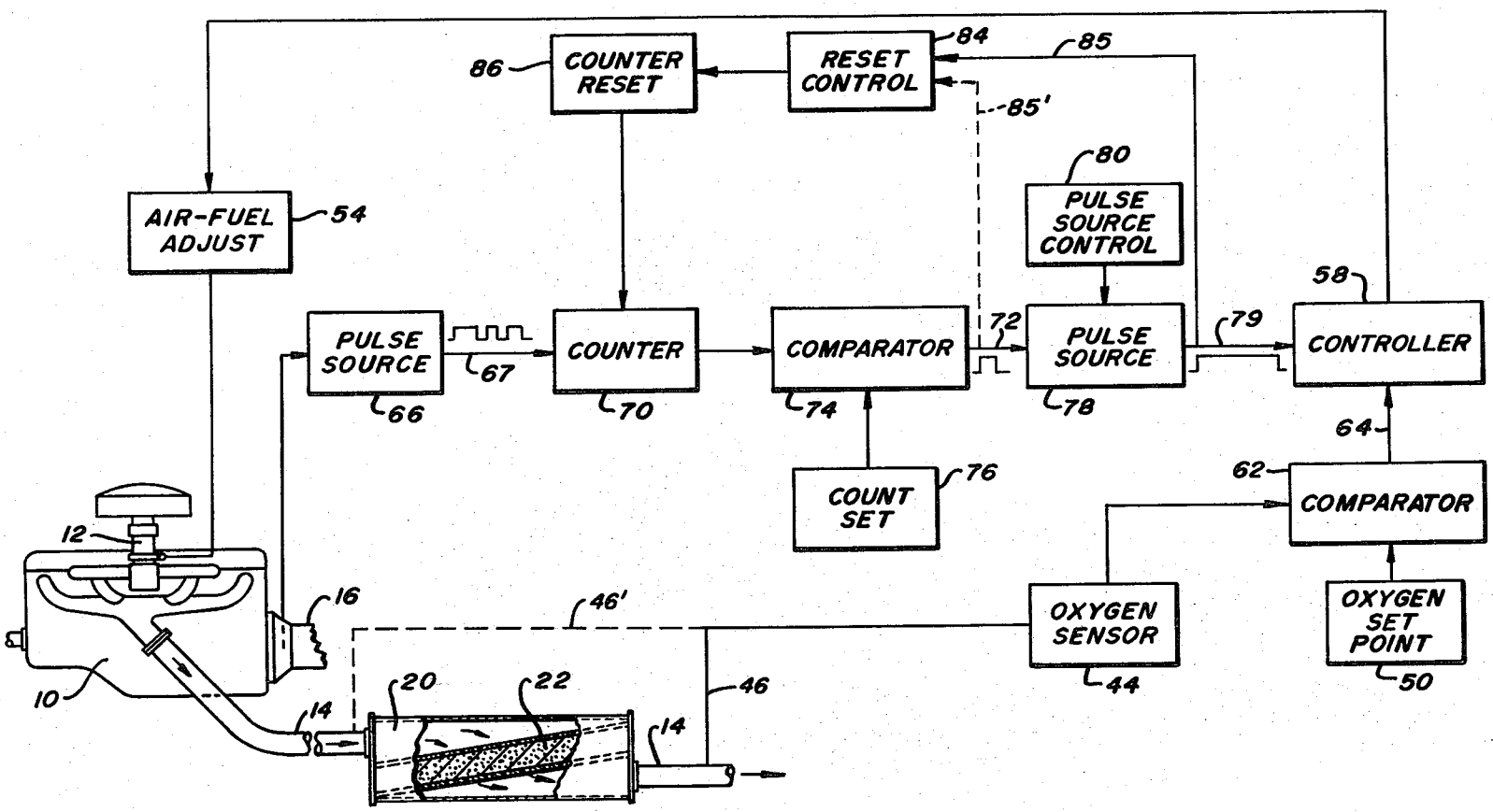
CONTROLLER
58
COMPARATOR
64
OXYGEN SET POINT
50
79
62
PULSE SOURCE CONTROL
80
PULSE SOURCE
78
OXYGEN SENSOR
44
85
85'
72
84
RESET CONTROL
COMPARATOR
74
76
COUNT SET
46
COUNTER RESET
86
COUNTER
70
46'
14
22
67
PULSE SOURCE
66
20
16
54
AIR-FUEL ADJUST
12
10

EXHAUST EMISSIONS CONTROL SYSTEM

CROSS-REFERENCE TO RELATED APPLICATION

This application is a continuation-in-part of copending application Ser. No. 286,650, filed Sept. 5, 1972, and now U.S. Pat. No. 3,797,301 the priority of which is hereby claimed.

BACKGROUND OF THE INVENTION

This invention relates to the control of exhaust emissions and particularly to a system capable of controlling nitrogen oxides as well as hydrocarbons and carbon monoxide generated by internal combustion engines.

In an effort to meet various governmental standards for exhaust emissions, many solutions have been proposed with varying degrees of success. Most, if not all, of the proposed solutions result in relatively poor fuel economy since they require the addition of secondary fuel to a catalytic or thermal reactor or else require that the engine be run on a rich mixture with secondary air added in the reactor.

In U.S. Pat. No. 3,696,618, assigned to a common assignee, an engine control system is disclosed which includes an analyzing means (specifically a temperature measurement device) connected to a catalytic converter for producing an indication of converter performance. This indication is compared to a set point means by an optimizer which produces a signal which in turn causes a control means to continually change the input to the converter to effect the optimization of the converter performance by various means, such as adjusting the fuel pressure in the float bowl, adjusting the choke, or adjusting the flow of secondary air.

In U.S. Pat. No. 3,768,259, assigned to a common assignee, an engine control system is disclosed wherein a solid electrolyte oxygen sensor is used to generate a signal indicative of the percentage of oxygen in the exhaust gas from either an engine or a converter attached to it, depending on the location of the sensor. The oxygen signal is then compared to a set point and used to continually regulate the engine to change its air-fuel ratio until the sensed oxygen concentration corresponds to a predetermined desired percentage which is preferably very close to the percentage corresponding to a stoichiometric air-fuel ratio.

In attempting to regulate an engine-converter system by continuously sensing the oxygen content of the exhaust gases, comparing it to a set point, and adjusting the air-fuel ratio in response to differences between the measured and desired oxygen contents it has been found that the device for adjusting the air-fuel ratio may have a tendency to hunt, especially when the engine's mode of operation is being changed rapidly. The tendency toward hunting results since changes made in the air-fuel ratio on a continuous basis are often not yet reflected in the oxygen content of the exhaust gases being sensed before new corrections are made in the air-fuel ratio. U.S. Pat. No. 3,759,232 shows an engine-catalytic converter system where an oxygen sensor is positioned upstream of the converter. Although such a system should have a faster response time than a system wherein the oxygen sensor is downstream of the converter, the disclosed system appears to sense the oxygen sensor voltage signal continuously and then average it out and make periodic corrections. Such a system would thus not make corrections based solely on changes in the exhaust gases caused by changes made in the air-fuel ratio and would tend to hunt.

SUMMARY

It is among the objects of the present invention to overcome various deficiencies of the prior art devices and provide an engine-converter control system which will be fast acting and yet not have a tendency to hunt so that exhaust pollutants will be controlled even when the mode of engine operation is changing relatively rapidly. These and other objects are attained by the present invention wherein an oxygen sensor is positioned downstream of an internal combustion engine. The oxygen sensor preferably comprises a solid electrolyte cell such as zirconium oxide stabilized with magnesium oxide or calcium oxide which will produce an electrical voltage in response to the difference in the partial pressures of oxygen on its opposite sides. When the atmosphere is in contact with the reference side of the sensing cell, voltage generated by the cell increases as the oxygen content of the exhaust gases decreases. Since it has been found that the nitrogen oxide, hydrocarbons and carbon monoxide content of the exhaust gases can each be kept within desired limits when the oxygen content of the exhaust gases is slightly above the plateau it maintains when the air-fuel mixture is rich, it is possible to measure the exhaust emissions from an engine system as the air-fuel ratio is changed and determine the oxygen level where the optimum conversion is taking place. The voltage generated by the oxygen sensor at this position of optimum conversion can then be noted and used as a set point for an automatic control system.

The control system of the present invention includes means for comparing the voltage generated by the oxygen sensor to a set point voltage corresponding to optimum conversion so as to produce a difference signal. The difference signal is then used to drive a means for adjusting the air-fuel ratio in a direction to cause the oxygen level of the exhaust gases to approach the set point level. Since a finite time interval is required for a change in the air-fuel ratio to be reflected in the exhaust gases, the system makes changes in a step-wise rather than continuous fashion and includes a time delay period between the time a step change is made and the time the oxygen level is sensed. The time delay is of sufficient length to permit the changed fuel composition to pass through the engine, exhaust pipe and, where the sensor is positioned downstream of the converter, the catalytic converter. Since a given fuel charge will move much faster at higher engine speeds than at idle, the delay is preferably proportional to the engine speed. In a preferred embodiment, the delay period is controlled by a means for counting engine revolutions. For even more accurate control, the delay period may be partially controlled by changes in the inlet manifold pressure since the product of the engine speed and the inlet manifold pressure provides a better indication of the time required for a given charge of air and fuel to pass through the engine and reach the sensor than does the engine speed alone.

BRIEF DESCRIPTION OF THE DRAWINGS

The FIGURE is a schematic block diagram showing an engine-converter system having its air-fuel ratio adjusted by a step type control circuit in response to changes in oxygen level in the exhaust path.

DESCRIPTION OF THE PREFERRED EMBODIMENT

The drawing schematically represents an internal combustion engine 10 having an air and fuel input means 12 such as a carburetor or fuel injection device and an exhaust pipe 14 for carrying away the products of combustion which include nitrogen oxides, carbon monoxide, hydrocarbons and oxygen. The power developed by the engine 10 is transmitted through a rotary drive member 16 to a transmission (not shown). To render the exhaust components which leave exhaust pipe 14 generally harmless, a catalytic converter 20 containing a catalyst bed 22 is provided downstream of the engine.

It is known that the concentrations of nitrogen oxides and carbon monoxide in the exhaust gases leaving the catalytic converter 20 are each relatively low when the air-fuel ratio is at stoichiometry. It is also known that the oxygen concentration in exhaust pipe 14 starts to rise quite rapidly as the engine operates on the lean side of stoichiometry as compared to the relatively low and constant concentration which it maintains when the engine is running rich and thus consuming almost all of the available oxygen. This sudden rise in the oxygen concentration at stoichiometry may be referred to as oxygen breakthrough. Since the oxygen breakthrough region corresponds to the region wherein the nitrogen oxides, carbon monoxide and hydrocarbons are at or close to their minimum levels, it is possible, by adjusting the air-fuel ratio so as to maintain the oxygen concentration (or the CO concentration) at a predetermined level, to also maintain the noxious gases and hydrocarbons at a particular level. Although the CO and HC concentration in the exhaust gases will decrease as the air-fuel ratio becomes leaner than stoichiometric, the NOx level will increase after having reached a minimum level at stoichiometry. The behavior of the exhaust gases makes it impossible in a single converter system to reduce the level of each pollutant to its absolute minimum. However, it is possible to select a specific air-fuel ratio for a given engine-converter system wherein the level of each pollutant can be kept below established standards.

Referring to the drawing, an oxygen sensor indicated schematically at 44 is attached to the exhaust pipe 14 either downstream of the converter 20 as shown by solid lead line 46 or upstream of the converter 20 as shown by dotted lead line 46'. Although a position downstream of the converter 20 gives somewhat better control of final emissions, an upstream position permits the sensor 44 to come to its operating temperature faster. The oxygen sensor 44 is preferably temperature compensated, such as disclosed in the aforementioned U.S. Pat. No. 3,768,259 and includes a solid electrolyte cell which is preferably made of zirconia stabilized with magnesium oxide or calcium oxide. The cell is exposed on one side to the exhaust gases and on the other side to a reference gas such as atmospheric air. Since the voltage generated by the cell is proportional to the difference in the oxygen partial pressures on the opposite sides of the cell, it follows that the cell will generate maximum voltage when the oxygen content of the exhaust gases in pipe 14 is at a minimum. By utilizing the voltage corresponding to the desired oxygen level as the oxygen set point voltage 50 in FIG. 1 it is possible, through appropriate adjustment and control circuitry, to adjust the air-fuel ratio automatically. The desired oxygen level or sensor voltage can be readily determined for a particular engine-converter-sensor combination by utilizing existing analyzers to monitor the exhaust gases as the air fuel ratio is varied. When the exhaust gases are at their optimum levels, the voltage produced by the oxygen sensor 44 is noted and then used as the set point 50.

The air fuel ratio to the engine 10 may be adjusted in a variety of ways such as by adjusting the choke angle, moving fuel metering rods, varying the pressure on the float bowl, or by providing fuel injectors to name a few. The adjustment means is indicated schematically at 54. The adjustment device 54 can be operated as needed by a suitable drive or controller 58 such as, for example, an electric stepping motor. The magnitude of adjustment required is directly proportional to the difference in voltage between the oxygen sensor 44 and the oxygen set point 50. Both of these voltages may be fed into a comparator device 62 which provides an output signal 64 to the controller 58. The output signal 64 determines both the direction of movement and the amount of adjustment to be provided by the controller 58. To provide a step type adjustment of the air-fuel ratio with a delay period between the adjusting movements of adjuster 54, the controller is permitted to operate for only a fixed increment of time during each step adjustment cycle. The time increment should, however, be sufficient for the air fuel adjuster 54 to be moved by the amount necessary to cause the air fuel ratio to change to that value corresponding to the set point oxygen level.

As previously noted, a finite time is required for changes in the air fuel ratio made at input means 12 to be reflected in the output from exhaust pipe 14. To minimize hunting of the system, the adjustments are made in steps and a delay is provided between adjustment steps. An example of one of many suitable electrical circuits using available elements for accomplishing such a delay is shown in FIG. 1 where the revolutions of the engine 10 are sensed by a pulse source device 66 and transmitted as pulses 67 having a width varying with the engine speed to a counter 70. The counter 70 counts the pulses into a comparator 74 which compares the counted pulses to a predetermined number of pulses determined by a count set device 76. When the counter 70 has counted in the number of pulses corresponding to the setting of the count set device 76, a pulse 77 is transmitted by the comparator 74 to a pulse source device 78 to cause it to transmit a pulse 79 to controller 58. The latter pulse determines the length of time the controller 58 can operate to adjust the adjusting device 54. A pulse source control device 80 controls the width of the pulse 79 transmitted by pulse source 78. A reset control 84 connected by lead 85 to the output of pulse source 78 preferably senses the rear edge of pulse 79 and triggers a counter reset device 86 to cause the counter 70 to start counting pulses 67 for a succeeding cycle of operation when one cycle is complete.

Since a finite time period is required in which to operate the controller 58 and make an adjustment in the air fuel ratio, while a variable time period, dependent on the engine speed, is required to permit the adjustment to be reflected in the exhaust gases in pipe 14, it is desirable that the length of time between adjusting operations consist of both a fixed and a variable segment. The fixed time segment is determined by the width of the pulse 79 and preferably should be made as short as possible while still permitting a maximum step adjustment to be made. The variable segment is determined by the setting of the count set device 76 and should correspond in length to the fewest number of engine revolutions necessary to pass a charge of air-fuel mixture from the carburetor 12 to the location of the oxygen sensor 44 in the exhaust pipe 14. Obviously, the time required for the air-fuel mixture to make this journey will be less when the sensor 44 is in the dotted line connection 46' than when it is in the solid line connection 46.

Although an air fuel ratio control system using a step adjustment cycle having both a fixed and variable time segment would provide a rapid response where an engine is repeatedly changing its mode of operation, an alternative cycle could also be used in which only a variable time period would be present. Such a cycle would merely involve the movement of lead 85 from the solid line position shown to the dotted line position indicated at 85'. In such a cycle the total cycle time would correspond to the setting of the count set device 76 with the adjustment of the air fuel ratio by controller 58 being made at the beginning of the cycle and the remainder of the cycle time being available to permit the system to respond to the change. If the cycle time of such an alternative system is chosen to permit proper correction at high speeds the time available for engine response at idle speed would be greater than necessary.

I claim as my invention:

1. In an engine system wherein fuel and air are admixed and combusted in an engine and the resulting exhaust gases containing harmful components are passed through a catalytic converter to be converted to generally harmless components, the improvement comprising:

(a) adjustment means attached to the engine for varying the fuel-air ratio of the engine;

(b) oxygen sensing means mounted in the exhaust path of the engine for generating an electrical signal in accordance with the percentage of oxygen present in the exhaust gases at that point;

(c) control means for comparing the electrical signal produced by said oxygen sensing means to a predetermined set point and causing said adjustment means to be actuated to a first fixed position when said electrical signal differs from the value corresponding to said set point; and (d) delay means including means for sensing a predetermined number of revolutions of the engine for preventing said control means from further actuating said adjustment means until the changes in the fuel-air ratio caused by adjusting the adjustment means to said first fixed position are reflected in the composition of the exhaust gases at the oxygen sensor position in the exhaust path.

2. An engine system in accordance with claim 1 wherein said adjustment means is operated in a step-like manner and wherein the cycle time from the start of one adjusting step to the start of the next one comprises a fixed time segment of sufficient length to actuate the adjustment means and a variable time segment produced by said delay means.

3. An engine system in accordance with claim 1 wherein said predetermined number of revolutions is sufficient to provide time, at various engine speeds, for the air fuel ratio to be adjusted and the resulting changes in exhaust gas composition to be sensed.

4. A method of providing control of hydrocarbons, carbon monoxide and nitrogen oxides in an engine system incorporating an internal combustion engine and a catalytic converter comprising the steps of:

(a) generating an electrical signal indicative of the oxygen content of the exhaust gases at a point in the exhaust path;

(b) comparing said electrical signal to a set point signal indicative of a desired oxygen content of said exhaust gases;

(c) using the difference signal between said electrical signal and said set point signal to drive an adjusting means for changing the air-fuel ratio to the engine; and (d) repeating said steps at intervals of time which are of sufficient length to permit the adjustment made in the air-fuel ratio to be reflected in a change in the oxygen content of the exhaust gases at the point where said electrical signals are generated, said steps being repeated at longer or shorter intervals in accordance with whether the engine is operating at a slow or fast rate, respectively, said intervals corresponding to the time required for a predetermined number of engine revolutions.

* * * * *